US005480136A

United States Patent [19]

Meyer

[11] Patent Number: 5,480,136

[45] Date of Patent: Jan. 2, 1996

[54] DEVICE FOR DEPOSITING SHEETS

[75] Inventor: Gerhard Meyer, Neusäss-Steppach, Germany

[73] Assignee: Franz Gremser KG, Neusass

[21] Appl. No.: 239,985

[22] Filed: May 9, 1994

[30] Foreign Application Priority Data

May 14, 1993 [DE] Germany ..... 43 16 220.7

[51] Int. Cl.[6] ..... B65H 43/00

[52] U.S. Cl. ..... 271/176; 271/183; 271/198; 271/203

[58] Field of Search ..... 271/176, 183, 271/69, 197, 198, 203, 227, 240, 280, 298, 302; 414/793.1

[56] References Cited

U.S. PATENT DOCUMENTS

| | | | |
|---|---|---|---|
| 3,123,354 | 3/1964 | Ungerer | 271/197 |
| 3,328,027 | 6/1967 | Schmidtke | 271/197 |
| 4,824,092 | 4/1989 | Kriefall et al. | 271/183 |

FOREIGN PATENT DOCUMENTS

| | | | |
|---|---|---|---|
| 0173959 | 3/1986 | European Pat. Off. | 271/197 |

*Primary Examiner*—David H. Bollinger
*Attorney, Agent, or Firm*—Collard & Roe

[57] ABSTRACT

In the case of a device for depositing sheets on a stack table having stack abutments, comprises a conveying system which includes a plurality of endless conveyor belts arranged in parallelism and mechanism to drive the conveyor belts at the same speed to convey the sheets separately in spaced relation to each other on an upper surface thereof, it is possible to ensure more gentle handling of the sheets and more reliable and troublefree operation together with operation at a higher speed if the device comprises a perforated belt system which overlaps the one end of the conveyor belt system and comprises a plurality of parallel endless perforated belts adapted to be driven by a motor at an adjustable speed, such perforated belt system extending over the stack table, a plurality of suction air ducts, which are respectively arranged behind each lower run of such perforated belt and are solely open toward the perforated belt, a source of vacuum which is connected with the ends of the vacuum ducts nearest to the conveyor belt system and is adapted to supply vacuum reducing the air pressure in the suction air ducts, and a motor control sensor adapted to respond to the leading edge of a sheet and to the fall of a sheet from the perforated belt duct system and able to be adjusted in the direction of movement of the sheet to a distance from the start of the suction air ducts, which is less than the sheet length, such sensor being adapted to accelerate the motor with the perforated belt system in alternation after the fall of a sheet to a high conveying speed and after engagement of the sheet to slow it down again.

14 Claims, 3 Drawing Sheets

DEVICE FOR DEPOSITING SHEETS

BACKGROUND OF THE INVENTION

The invention relates to a device for depositing sheets on a stack table having stack abutments, comprising a conveyor belt system which includes several endless conveyor belts arranged in parallelism and means to drive the conveyor belts at the same speed to convey the sheets separately in spaced relation to each other on an upper surface thereof.

Such sheet depositing devices are employed following certain sheet processing equipment such as screen printing machines, varnishing or laminating machines and the like, in which the sheets are not moved by grippers. Such sheet delivery devices suffer from the disadvantage that more especially thin sheets are crumpled at high speeds of operation so that not only the sheets themselves are wasted but furthermore they interfere with the orderly production of a stack of sheets.

SHORT SUMMARY OF THE INVENTION

Taking this prior art as a starting point one object of the invention is to provide a device of the type initially mentioned which renders possible a dependable and troublefree means of stacking which does not damage the sheets.

A still further object of the invention is to provide a device capable of operation at high rates of delivery.

In order to achieve these and/or other objects appearing from the present specification, claims and drawings, in the present invention a device for depositing sheets on a stack table having stack abutments, comprises a conveying system which includes a plurality of endless conveyor belts arranged in parallelism and means to drive the conveyor belts at the same speed to convey the sheets separately in spaced relation to each other on an upper surface thereof, a perforated belt system which overlaps the one end of the conveyor belt system and comprises a plurality of parallel endless perforated belts adapted to be driven by a motor at an adjustable speed, such perforated belt system extending over the stack table, a plurality of suction air ducts, which are respectively arranged behind each lower run of such perforated belt and are solely open toward the perforated belt, a source of vacuum which is connected with the ends of the vacuum ducts nearest to the conveyor belt system and is adapted to supply vacuum reducing the air pressure in the suction air ducts, and a motor control sensor adapted to respond to the leading edge of a sheet and to the fall of a sheet from the perforated belt duct system and able to be adjusted in the direction of movement of the sheet to a distance from the start of the suction air ducts, which is less than the sheet length, such sensor being adapted to accelerate the motor with the perforated belt system in alternation after the fall of a sheet to a high conveying speed and after engagement of the sheet to stow it down again.

The operation of the device in accordance with the invention is such that as soon as a sheet has reached the leading end of the suction ducts it is drawn by vacuum against the perforated belts, that is to say it is engaged in a gentle manner, and is moved at a high conveying speed over the stack in order to ensure there being a sufficient time for reliable deposit before the arrival of the next sheet. Thereafter the sheet is decelerated to prevent crumpling or smashing at the leading abutment of the stack, when the sheet drops off the perforated belt because it has run over front end of the suction ducts and there is accordingly a collapse of the vacuum at the perforated belt.

In accordance with a further advantageous development of the invention a fixed sheet leading edge sensor, which is arranged over the conveyor belt, and furthermore a sheet trailing edge sensor, which is able to be adjusted to the length of the sheets to be deposited, are provided. In this respect the sheet trailing edge sensor is coupled with the motor control sensor for the adjustment to the sheet length, Accordingly it is possible to ensure adjustment of the motor control sensor in a fashion promoting reliable operation of the sheet deposit system with a test sheet.

It is preferred to arrange two side edge sensors over the conveyor belt system to respectively detect a sheet side edge. The side edge sensors are coupled with one another for adjustment to suit the sheet width. This arrangement creates not only the possibility of adaptation of the side position of, more particularly, the outer perforated belts of the perforate belt system and/or switching off conveying and perforated belts not required for the deposit of extremely narrow sheets, but furthermore offers the advantage, in conjunction with the sheet leading edge sensors and sheet trailing edge sensors, that sheets which have run skew in the system will be recognized as rejects.

In order to keep any reject sheets clear of the stack which would otherwise hinder proper stack formation, in accordance with a further development of the invention the sensors arranged over the conveyor belt system are in operation adapted to be activated in synchronism on the passage of each sheet. Then on detecting a reject sheet the sensors provide a signal for the switching on a mechanical sheet diverting switch, which re-directs the reject sheets to a test sheet receiving means.

Further advantageous developments and convenient forms of the invention will be understood from the following detailed descriptive disclosure of two embodiments thereof in conjunction with the accompanying drawings.

LIST OF THE SEVERAL VIEWS OF THE FIGURES

DETAILED ACCOUNT OF WORKING EMBODIMENTS OF THE INVENTION

Figure 1:
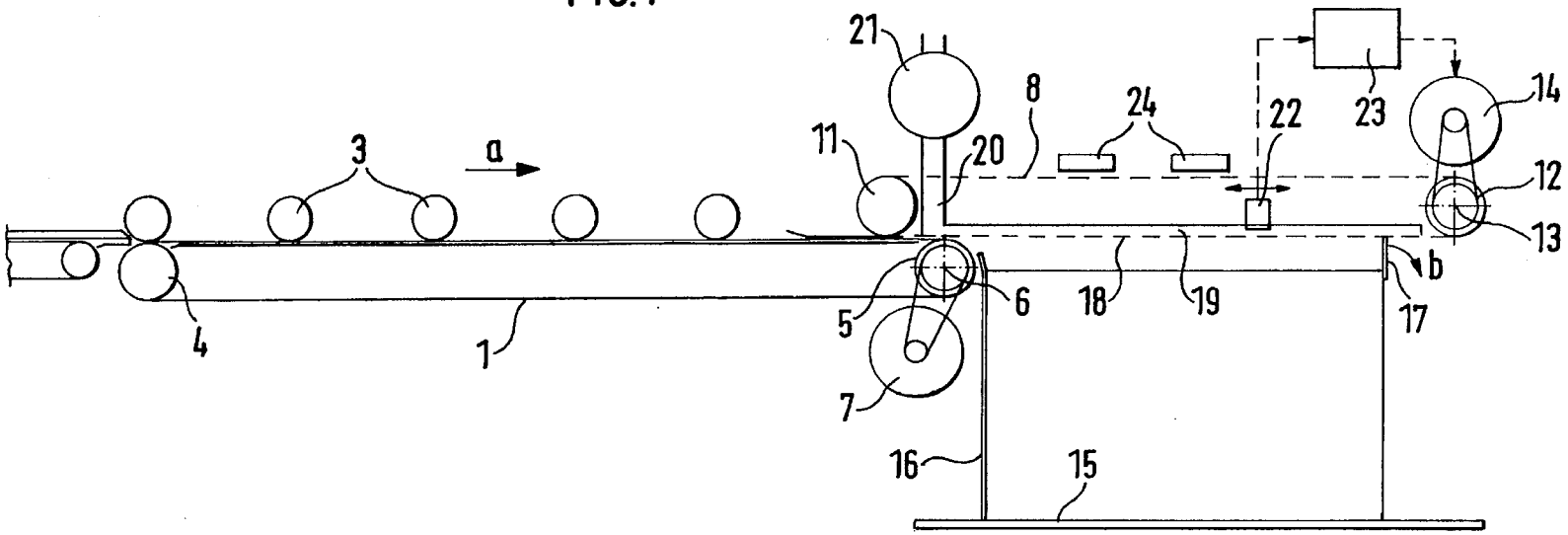
FIG. 1 is a side elevation of a first working embodiment of the invention.
Figure 2:
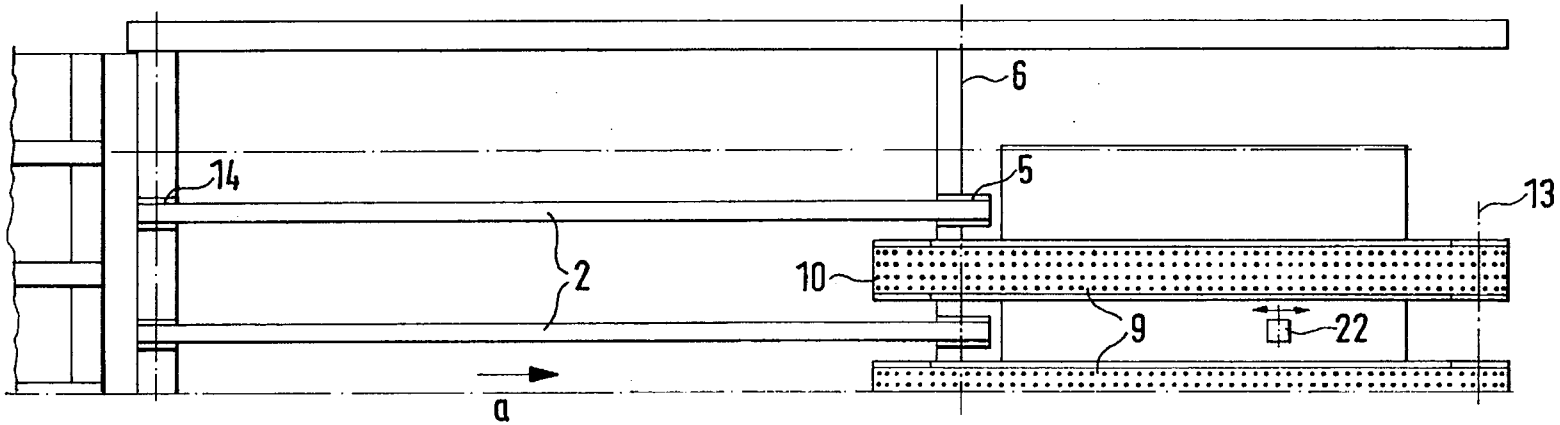
FIG. 2 is a plan view of one half of the belts of the arrangement in accordance with FIG. 1.

The arrangement as depicted in FIGS. 1 and 2 comprises a conveyor belt system generally referenced I which includes several endless, parallel conveyor belts 2 and, at a higher level, loading idler rollers 3. The belts are trained over bend rollers 4 and 5. The bend rollers 5 are keyed on a shaft 6, which is driven by means of a motor 7. The motor 7 and accordingly the conveyor belt system is driven at a predetermined, constant conveying speed. The conveying speed is higher than the speed of the sheets coming from the preceding sheet processing equipment. The conveyor belt system 1 conveys the sheet separately with a distance between them on its top side in the direction of the arrow a.

A perforated belt system generally referenced 8 extends across the rear end of the conveyor belt system 1. The perforated belt system 8 possesses a plurality of endless perforated 9 belts arranged in parallelism, which are provided with perforations 10 over their entire circumference. It is convenient if the perforations 10 are arranged in rows which are perpendicular to the direction a of conveying. The perforated belts 9 are trained around bend rollers 11 and 12. The bend rollers 11 run idly. The bend rollers 12 are mounted on a shaft 13, which is driven by means of a motor 14. The perforated belts 9 are, as shown in FIG. 2, best arranged with a offset in relation to the conveying belts 2. The central perforated belt 9 may be arranged so that it is not adjustable in position whereas the lateral perforated belts are able to be adjusted in position.

The perforated belt system 8 extends across a stack table 15, on which the sheets are stacked. Front and rear stack abutments 16 and 17 are provided on the stack table. In addition it is possible to provide lateral stack abutments as well.

Behind the lower run of each perforated belt 9 a suction or vacuum duct 19 is provided, which is merely open toward the lower run 18. At the end, which is nearer the conveyor belt system 17 of the vacuum ducts 19 connecting ducts 20 open, which lead to a vacuum shaft 21, as for instance a blower.

Between two perforated belts 9 a motor control sensor 22 is arranged, which is able to be adjusted in the direction of the arrow a and in the opposite direction. The motor control sensor 22 is preferably designed in the form of a reflected light scanning means. The motor control sensor 22 is connected with a control unit 23, in which its signals are converted for the control of the speed of the motor 14.

When a sheet is supplied by means of the conveyor belt system 1 so that its front part covers over the first row of the perforations 10 in the perforated belts 9, behind which the vacuum ducts begin, there will then be a suction air current in the parts of the vacuum ducts 19 covered by the sheet, such current leading to a reduction in the pressure in the vacuum ducts 19 in that part. Consequently the sheet will be thrust against the perforated belts 9 against the action of the surrounding air until the first row of perforations behind trailing edge of the sheet sweeps over the beginning of the vacuum ducts. At this instant the vacuum in the vacuum duct 19 will suddenly collapse and the sheet will fall from the perforated belt 9 without additional control means having to be provided for this purpose.

The motor control sensor 22 is so set that the sheet leading edge reaches the sensor zone shortly before the sheet drops off the perforated belts 9. When this happens the sensor 22 will send a control signal to the control unit 23, which causes a substantial deceleration of the motor 14 and therefore of the perforated belt system 8. Such deceleration may be such as to stop of the motor 14. Accordingly the sheet as well will be powerfully decelerated directly prior to its release by the perforated belts 9. It will therefore only move at a low speed against rear stack abutments and can therefore not be crumpled. As soon as the sheet emerges from the zone detected by the sensor 22 on falling off the perforated belt system 8 such sensor will send a further signal to the control unit 23, this leading to a renewed acceleration of the motor 14. Preferably, the motor is so speeded up that the perforated belt 8 has approximately the same speed as the perforated belt system 1, when the sheet reaches the first row of the perforations 10 underneath the vacuum duct 19. This speed may be the maximum speed of the perforated belt system 8. However, there is also the possibility of accelerating the perforated belt system again for a short period of time.

In order to speed up the fall of the sheet onto the stack formed on the stack table 15, blowing air producing means 24 are provided over the perforated belt system 8, which produce a compressed air current thrusting the sheets downward. The blowing air supply means 24 can be designed so that they are switched merely during the sheet drop phase or may be so designed that the force acting on the sheet by she compressed air current is smaller than the force of the vacuum holding the sheet on the perforated belt system.

In order to remove a test sheet it is possible in this arrangement to move over the rear stack abutment 17 to be folded over in the direction of the arrow b.

Figure 3:
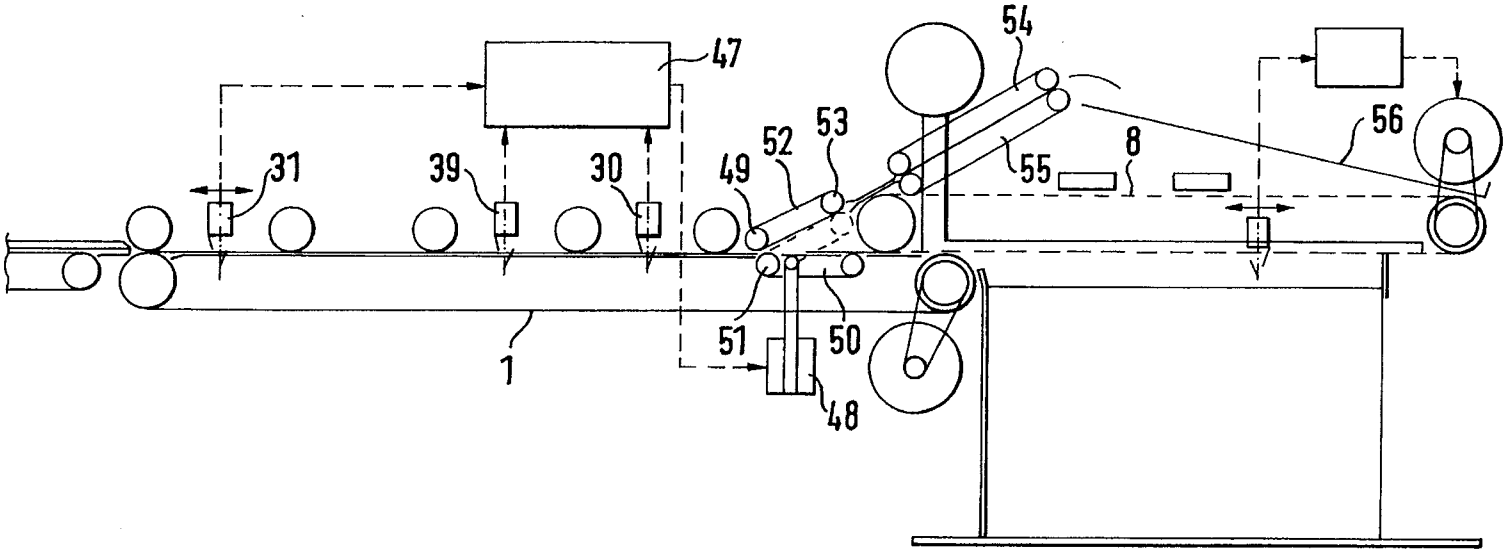
FIG. 3 is a lateral elevation of a second working embodiment.
Figure 4:
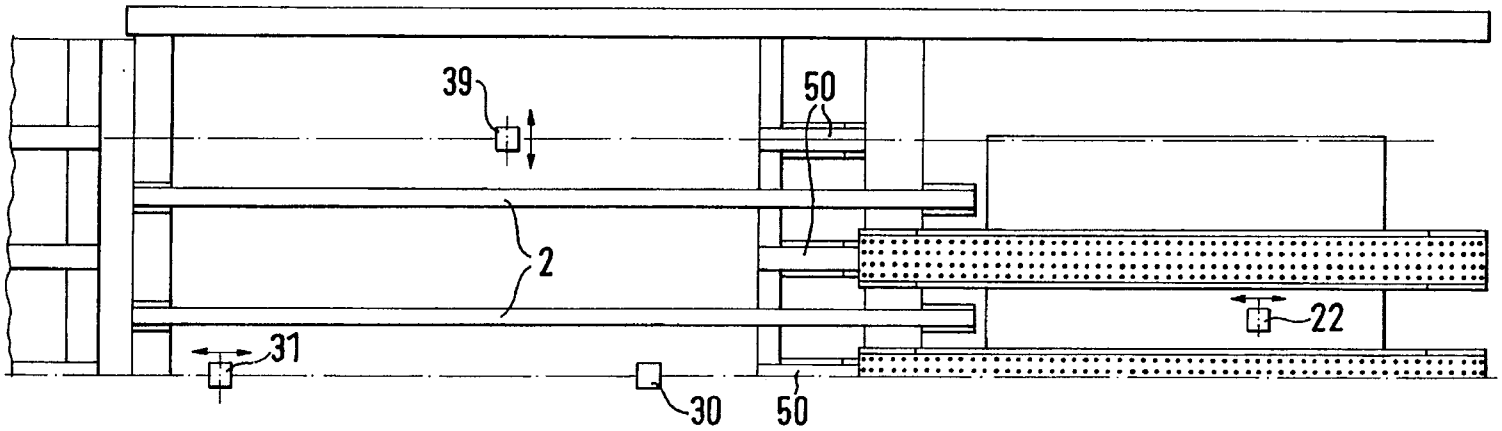
FIG. 4 is a view of the one half of the belt arrangement in accordance with FIG. 3 looking downward.
Figure 5:
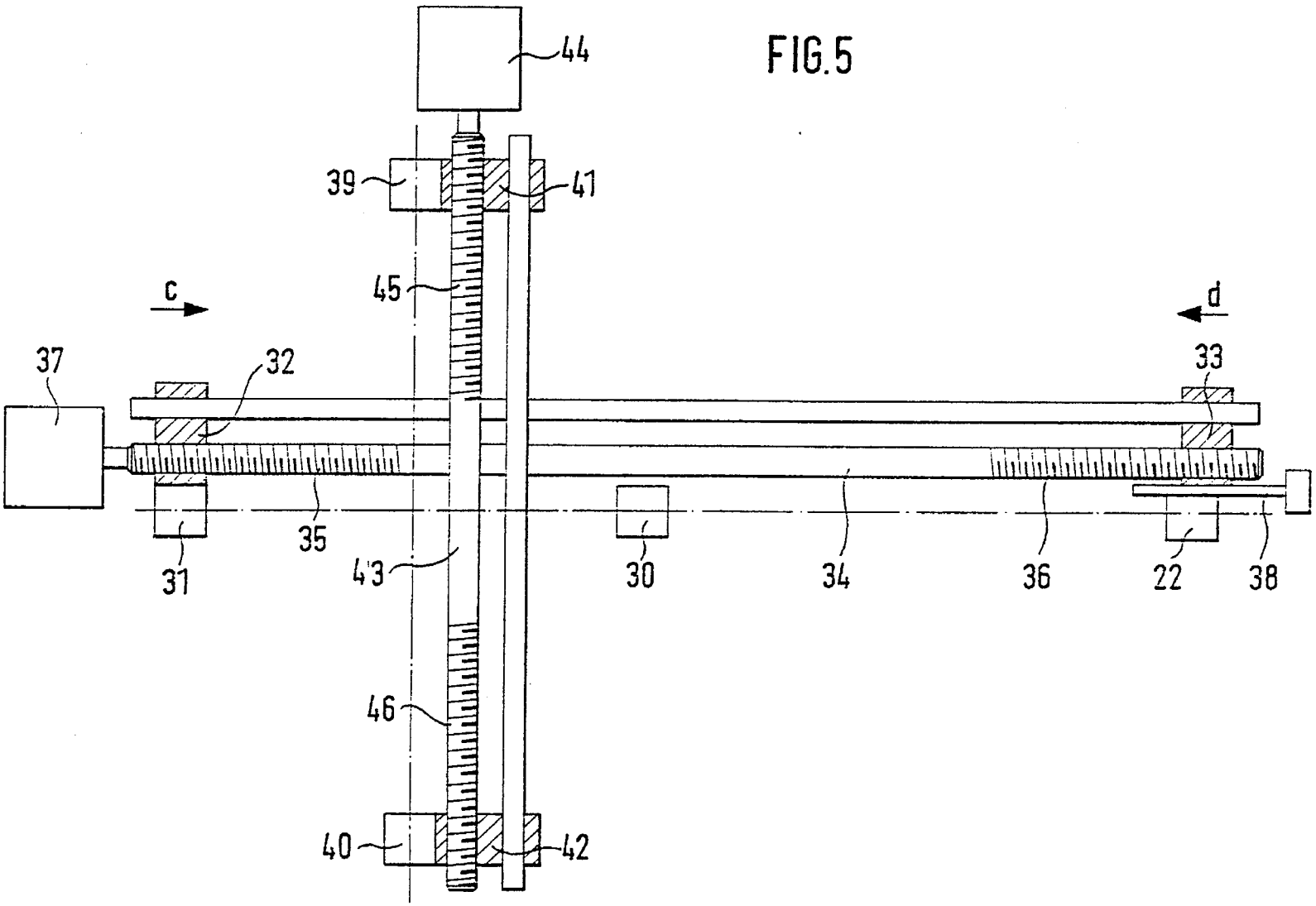
FIG. 5 is a plan view of the means for the adjustment of the sensors of the arrangement according to FIG. 3.

Should the presence of sheets of the conveyor belt system 1 which are skewed to a considerable extent is likely, then a device in accordance with FIGS. 3 through 5 can be employed. In the case of this working embodiment parts present in the first embodiment are denoted by the same reference numerals in the first embodiment and are not described over again, In this case a fixed sheet leading edge sensor 30 is arranged over the conveyor belt system 1 with the conveyor belts 2 together with a sheet trailing edge sensor 31. The sheet trailing edge sensor 31 is mounted on a saddle 32 which runs along a straight line. In the same fashion the motor control sensor 22 is arranged on a saddle 33, which is also able to move along a straight line. The two saddles are connected together by means of a setting shaft 34 or lead screw. For this purpose the setting shaft 34 possesses a screw thread 35 in engagement with a mating screw thread on the saddle 32 and a mating screw thread 36 of opposite hand. The setting shaft 34 is able to be rotated by means of a setting motor 37. By rotation of the setting shaft 34, which causes a linear movement of the saddle 32 in the direction of the arrow d, the saddle 33 is therefore simultaneously shifted in the direction of the arrow d, By putting in a test sheet, which is moved forwards until the sheet leading edge sensor 30 responds, then moving the sheet trailing edge sensor 31 from its left hand initial position as far as the response to the sheet trailing edge it is therefore possible to set the motor control sensor 22 to a position adapted to the length of the sheets to be processed. In order in addition to be able to take into account different sheet weights for the same sheet dimensions, the motor control sensor 22 is furthermore able to be set along a guide 38. Using the sheet trailing edge sensor 31 it is possible, if a respective connection is provided, to shift the adjustable stack abutmerits, in this case the front ones, in opposite directions in the present arrangement.

Furthermore two sheet side edge sensors 39 and 40 are provided. The same are mounted on saddles 41 and 42, which are so set that they may be shifted linearly transversely in relation to the direction a of movement of the sheets. The saddles 41 and 42 ere connected together by means of a setting shaft 43, which is driven by a setting motor 44. The setting shaft 43 is for its part provided with two screw threads 45 and 46 of opposite hand, which are respectively in engagement with a mating thread on the saddles 41 and 42, After a test sheet has been introduced the sheet side edge sensors 39 and 40 are moved toward each other by means of the setting motor 44 until the sensors respond. In a simple case adjustment by means of a hand wheel may be provided for as well. The setting movement may in addition be employed to set the lateral position of the stack side abutments and of the belts of the conveyor system 1 and/or of the perforated belt system 8 in accordance with the width of the sheets, The same applies for any lateral abutments arranged adjacent to the conveying system 1, such as lateral pushing means, sheet metal guides or the like. The outer perforated belts 9 are in this case set to be somewhat inside the sheet lateral edges. These adjustable perforated belts 9 may be mounted on laterally adjusting beams drivingly connected with the sheet side edge sensors 39 and 40. On such beams it is furthermore possible for the stack lateral abutments and/or lateral abutments of the conveying duct to be mounted. The central vacuum belt 9 may be arranged in a stationary manner. However it would be feasible to turn off belts of the conveyor belt system 1 and of the perforated belt system 8 which are not required, more particularly when processing extremely narrow sheets. The adjustments mentioned are performed prior to starting operation of the sheet depositing device.

The sensors 30, 31, 39 and 41 are connected with a further control unit 47, by which it may be operated synchronously during operation. The sensors 30, 31, 39 and 40 scan a sheet after they have been put into operation. If all the sensors respond simultaneously, then the sheet will be in the correct position and may go on into the perforated belt system. However, if the sheet is conveyed in a skew setting, then it is not possible for all sensors to respond simultaneously. The control unit 47 then receives a signal to the effect that a reject sheet is on the conveyor belt system 1. In the case of such a signal indicating the presence of a reject sheet, a setting device 48, as for example an electromagnet, will be operate to set a mechanical sheet diverting switch generally referenced 49. In the illustrated working embodiment of the invention the mechanical sheet diverting switch comprises several endless, driven lower conveyor belts 50, which are able to be pivoted around the axis of the front bend rollers 51. Further conveyor belts 52 are arranged over the conveyor belt system 1 and are able to be pivoted about the axis of the rear bend rollers. During normal operation the sheets will run without making contact with the conveyor belts 50 and 52 from the conveyor belt system 1 to the perforated belt system 8. When a sheet runs skew the rear end of the conveyor belt 50 will be lifted so that the two conveyor belts will form a gap diverting the sheet resting on the conveyor belt system 1. By means of the conveyor belts 50 and 52 the sheet will then be passed over further conveyor belts 54 and 55 to a test sheet receiving means 56. The sheet diverting switch 49 may in addition be operated by hand, when a test sheet is to be removed. Instead of the sheet diverting switch described it is also possible to utilize other known sheet diverting switches, as for example those having a diverting tongue.

I claim:

1. A device for depositing sheets on a stack table having stack abutments, comprising a conveying system which includes a plurality of endless conveyor belts arranged in parallelism and means to drive the conveyor belts at the same speed to convey the sheets separately in spaced relation to each other on an upper surface thereof;

a perforated belt system which overlaps the one end of the conveyor belts and comprises a plurality of parallel endless perforated belts driven by a motor at an adjustable speed, such perforated belt system extending over a stack table;

a plurality of suction air ducts, which are respectively arranged behind each lower run of said perforated belts and are solely open toward the perforated belts;

a source of vacuum which is connected with the ends of vacuum ducts nearest to the conveyor belts and is adapted to supply vacuum reducing the air pressure in the suction air ducts; and a motor control sensor adapted to respond to the leading edge of a sheet and to the fall of a sheet from the perforated belt duct system and able to be adjusted in the direction of movement of the sheet to a distance from the start of the suction air ducts, which is less than the sheet length, such sensor being adapted to accelerate the motor with the perforated belt system in alternation after the fall of a sheet to a high conveying speed and after engagement of the sheet to slow down again the perforated belt system.

2. The device as claimed in claim 1, wherein the said motor and said perforated belt system are able to be decelerated by said motor control sensor until said perforated belt system is stationary.

3. The device as claimed in claim 1, wherein a speed of conveying is generally equal to a speed of the conveyor belts.

4. The device as claimed in claim 1, wherein the conveyor belts are arranged with a lateral offset in relation to the perforated belts.

5. The device as claimed in claim 1, further comprising at least one blowing air producing means arranged over the perforated belt system for supplying air to temporarily act on the top side of a sheet.

6. The device as claimed in claim 1, further comprising a fixed position sheet leading edge sensor and a sheet trailing edge sensor and means for adjusting said trailing edge sensor and to be adjusted to the sheet length, said sheet trailing edge sensor being coupled with the motor control and preferably with at least one associated stack abutment.

7. The device as claimed in claim 6, wherein said sheet trailing edge and said motor control sensor are arranged on two saddles which are coupled together by means of a common oppositely acting setting drive.

8. The device as claimed in claim 6, comprising two sheet side edge sensors adapted to detect a sheet side edge, said sheet side edge sensors being coupled together for movement in opposite directions and being coupled with the stack side abutments and, with the side abutments arranged adjacent to the conveying system.

9. The device as claimed in claim 8, wherein the two side edge sensors are arranged on two saddles coupled together by means of a common oppositely acting setting drive.

10. The device as claimed in claim 6, wherein the sensors are designed in the form of reflected light switches.

11. The device as claimed in claim 6, wherein the sensors arranged above the conveyor belts are during operation adapted to be activated in synchronism on the passage of each sheet and on detecting a reject sheet to send a signal for the switching on of a mechanical sheet diverting switch leading to a test sheet receiving means.

12. The device as claimed in claim 11, wherein said mechanical sheet diverting switch comprises at least one conveyor belt able to be pivoted underneath the top surface of the conveyor belt around axis of a bend roller, said bend roller being able to be pivoted into a position constituting an inlet hopper.

13. The device as claimed in claim 6, comprising means for adjusting the motor control sensor in order to take into account different paper weights in the direction of sheet travel and oppositely thereto.

14. The device as claimed in claim 1, wherein said mechanical sheet diverting switch is adapted to be operated by hand for removal of a test sheet.

* * * * *